US006506035B1

(12) United States Patent
Beck et al.

(10) Patent No.: US 6,506,035 B1
(45) Date of Patent: Jan. 14, 2003

(54) ROLLER FOR PERISTALTIC PUMPS HAVING A PLURALITY OF PROJECTIONS TO MINIMIZE CURRENT DRAW

(75) Inventors: Kent F. Beck, Layton, UT (US); Scott D. Miles, Sandy, UT (US); James A. Malmstrom, Kaysville, UT (US)

(73) Assignee: Zevex, Inc., Salt Lake City, UT (US)

( * ) Notice: Subject to any disclaimer, the term of this patent is extended or adjusted under 35 U.S.C. 154(b) by 0 days.

(21) Appl. No.: 09/812,718

(22) Filed: Mar. 20, 2001

(51) Int. Cl.[7] ..... F04B 43/12
(52) U.S. Cl. ..... 417/477.3; 417/476
(58) Field of Search ..... 417/477.3, 477.1, 417/476

(56) References Cited

U.S. PATENT DOCUMENTS 2,899,907 A * 8/1959 Becher ..... 417/477.6
3,768,934 A * 10/1973 Magerle ..... 417/477.3
3,790,313 A * 2/1974 Magerle ..... 417/477.3
4,229,299 A * 10/1980 Savitz et al. ..... 417/477.3

FOREIGN PATENT DOCUMENTS

DE 2447005 A * 7/1975 ..... 417/477.3

* cited by examiner

*Primary Examiner*—Cheryl J. Tyler
(74) *Attorney, Agent, or Firm*—Morriss Bateman O'Bryant & Compagni

(57) ABSTRACT

An improved roller for peristaltic pumps includes a central portion and a plurality of projections extending radially outwardly from the central portion. The projections enable use of a roller having a larger diameter, while ensuring that the tube carrying the solution is effectively pinched off. The larger diameter roller provides a greater moment arm and decreases current draw. The small projections used to accomplish the seal also severely deforms a smaller amount of tubing and thus requires less current draw.

20 Claims, 3 Drawing Sheets

ROLLER FOR PERISTALTIC PUMPS HAVING A PLURALITY OF PROJECTIONS TO MINIMIZE CURRENT DRAW

BACKGROUND OF THE INVENTION

1. Field of the Invention

The present invention relates to the rollers of a peristaltic pump rotor which is used for the administration of enteral and/or parenteral solutions to a patient. More particularly, the present invention relates to rollers which provides decreased current draw, while ensuring precise volume measurement as the peristaltic pump rotor rotates.

2. State of the Art

The use of peristaltic pumps and infusion sets to administer solutions to patients is well known in the medical arts. Pumps and infusion sets are used for both enteral and parenteral applications. Enteral feeding pumps are used to provide patients with nutrition and medication when they are unable, for a variety of reasons, to eat normally. Parenteral (intravenous) pumps are used to provide solutions to ensure adequate hydration and to provide needed nutrients, minerals and medication directly into the blood stream of the patient.

The rate at which the solution enters the body can be controlled in a variety of different ways. With parenteral applications, it is not uncommon for the infusion set to be placed in a free standing arrangement so that gravity helps force the solution into the patient. The rate at which the solution enters the patient also can be roughly controlled by various clamps, such as roller clamps, which are currently available on the market.

In many applications, however, it is necessary to precisely control or monitor the amount of solution which enters the patient. When this is the case, a regulating device, such as an enteral feeding pump or a parenteral infusion pump, is placed along the infusion set to control the rate at which the solution is fed to the patient. In applications where a pump is used, the clamps used to regulate flow are typically opened to their fullest extent to prevent the clamp from interfering with the proper functioning of the pump. The clamp is opened with the expectation that the enteral feeding pump will control fluid flow through the infusion set.

Enteral and parenteral pumps are desirable because they enable precise control over the solution flow rate. This can be accomplished with a variety of pumping mechanisms.

One common pump is a peristaltic pump in which a rotor is provided with a plurality of rollers (typically three). The rollers engages a flexible tube which is wrapped around the rotor in a U-shape. As the rotor turns, the tube is selectively pinched off between adjacent rollers to form a section of the tube with a predetermined amount of solution. Each partial rotation of the rotor, causes the predetermined amount of solution to be moved from the upstream side to the downstream side of the tube. By tracking the number of rotations (or partial rotations) of the rotor, the amount of solution delivered can be determined with a high degree of accuracy.

The use of such rotors has greatly improved the mobility of patients who must use enteral or parenteral pumps. Pumps which use rotors and other flow measuring devices to confirm delivery rates are described in U.S. Pat. Nos. 5,514,102 and 5,531,680.

Prior to the development of mobile pumps such as those described in the above-referenced patents, patients who used enteral feeding pumps and the like were often hooked to a pole which carried their enteral feeding solution. While receiving medication or nutrient solution, the patient would be limited in mobility to wherever the pole could be moved. The inventions described in the above-referenced patents have increasingly enabled patients to use portable pumps which operate on batteries. This enables many patients to enjoy activities such as camping and hiking that were previously very difficult, if not impossible.

One continual concern with portable enteral feeding pumps and other types of peristaltic pumps is the amount of current consumed. Those skilled in the art will appreciate that the amount of current draw directly effects the battery life, and thus the amount of time which a patient can use the pump without requiring a recharge. If the current draw can be reduced, the pump will be able to operate longer on a given charge and enable the patient to participate in camping and other activities on a more prolonged basis.

One mechanism for decreasing current draw is to increase the radius of the roller on the rotor. The increased radius provides a larger moment arm and reduces the current required to operate the rotor. Increasing the radius of the roller, however, raises the problem of sealing the tube segments. If the roller gets much larger in diameter than those commonly used (i.e. 0.215 inches in diameter), it becomes increasingly difficult to collapse the tube to define a discreet segment. Without discreet segments being formed in the tube, it becomes very difficult to determine the amount of liquid which actually flows through with each rotation. While there are mechanisms which will enable such determination, they are generally costly and may interfere with portability of the pump. Thus, rotor rollers have generally been between 0.15 and 0.30 inches in diameter when used with a ¼ inch outside diameter tube.

Thus, there is a need for a roller and a method of using a roller which reduces current draw, but which does not interfere with accurate flow determination. Such a roller should be easy to use and should not otherwise interfere with operation of the pump.

SUMMARY OF THE INVENTION

Thus, it is an object of the present invention to provide an improved roller for peristaltic pumps.

It is another object of the present invention to provide such a roller which decreases current draw in an enteral or parenteral pump.

It is yet another object of the present invention to provide such a roller which does not interfere with determination of fluid flow through the pump.

The above and other objects of the invention are realized in specific illustrated embodiments of an improved roller for peristaltic pumps. The roller has a central portion configured for rotation, and a second portion which projects from the central portion.

In accordance with one aspect of the invention, the roller has a plurality of projections which extend outwardly from the central section. The projections are positioned to engage the flexible tube wrapped around the rollers. The projections allow a roller of larger overall diameter to still pinch off the flexible tube into discreet segments.

In accordance with another aspect of the invention, the roller is formed with a plurality of outwardly extending arms to provide an increased effective radius, and a sharper radius to pinch off and thus seal the flexible tube. Because of the spacing between the ends of the arms, however, the roller is able to pinch off the flexible tube which is wrapped around the rotor.

While described herein as projections, those skilled in the art will appreciate that the roller could be made of a larger diameter and then have portions cut out or otherwise removed to leave a non-circular circumference. As used herein, references to projections are intended to include protrusions which are left on such a roller.

BRIEF DESCRIPTION OF THE DRAWINGS

The above and other objects, features and advantages of the invention will become apparent from a consideration of the following detailed description which is intended to discuss preferred embodiments of the invention, but not to limit the claims to those preferred embodiments. The detailed description is presented in connection with the accompanying drawings in which:

DETAILED DESCRIPTION

Reference will now be made to the drawings in which the various elements of the present invention will be given numeral designations and in which the invention will be discussed so as to enable one skilled in the art to make and use the invention. It is to be understood that the following description is only exemplary of the principles of the present invention, and should not be viewed as narrowing the pending claims.

Figure 1:
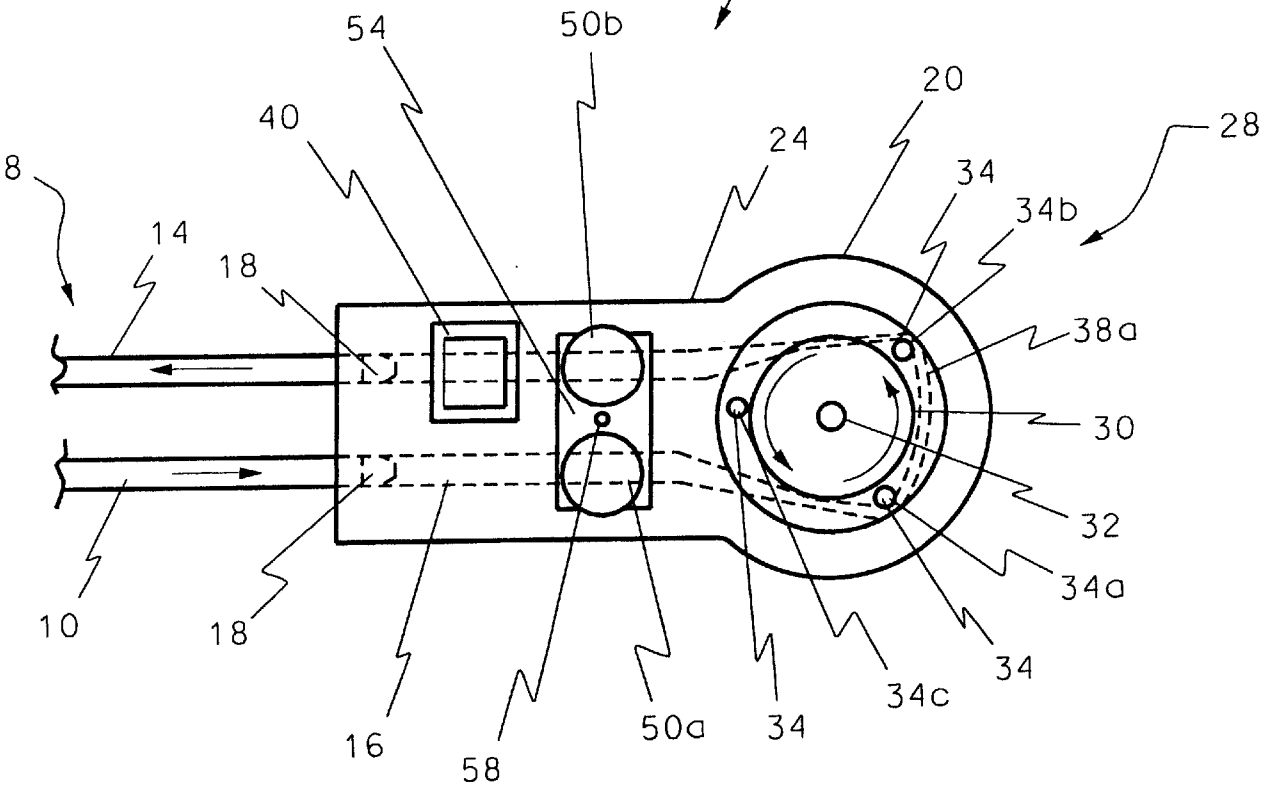
FIG. 1 (Prior Art)
FIG. 1 shows a bottom view of an enteral feeding pump with a flexible infusion set disposed therein, the feeding pump and infusion set being made in accordance with the teachings of the prior art.

Referring to FIG. 1, there is shown a bottom view of an enteral feeding system, generally indicated at 4, having a delivery set 8 including an intake (upstream) tube 10 and an output (downstream) tube 14 connected together by a pair of connectors 18 and a pump tubing segment within an enteral feeding pump 20. (A more detailed discussion of the enteral feeding system is contained in U.S. Pat. No. 5,514,102, which is expressly incorporated herein).

The position of the pump tubing segment disposed inside of the pump 20 is represented by the dashed lines 16. Typically an opposing end (not shown) of the inlet tube 10 would be connected to a supply container (also not shown) and an opposing end (not shown) of the output tube 14 would be attached to a patient so as to deliver solution provided by the pump 20.

The enteral feeding pump 20 includes a housing 24 with a conventional motor unit, generally indicated at 28. The motor unit 28 includes a rotor 30 with a plurality of peristaltic rollers 34 disposed about an exterior of the rotor to move liquid through the enteral feeding pump 20. The rotor 30 is connected by a shaft 32 to a motor (not shown). The section 38 of the pump tubing segment 16 is disposed about the rotor 30 and rollers 34 and is usually made of a flexible silicone material.

The portion 38*a* of the pump tubing segment 16 which is disposed between rollers 34*a* and 34*b* contains a predetermined amount of solution because the rollers 34*a* and 34*b* pinch off the tube and prevent the solution from moving upstream or downstream. Rotating the rotor 30 in the direction indicated by the arrows causes roller 34*a* to move to the position of roller 34*b*. As roller 34*a* moves along the tube 16 and roller 34*b* moves away from the tube, the roller 34*a* forces the solution contained in area 38*a* to move downstream and through the output tube 14. Typically, each rotation of the rotor will move about ¼ ml of solution.

The movement of the roller 34*a* into the position of roller 34*b*, occurs simultaneously with the movement of roller 34*c* from the position shown in FIG. 1 to the position previously having roller 34*a*. Thus, another predetermined amount of solution becomes trapped in the segment 38*a* and is ready to be advanced down stream by another ⅓ rotation of the rotor 30.

Also shown in FIG. 1 are additional mechanisms for ensuring that a desired amount of solution has been advanced by the rotor 30. An air detector 40 is provided to warn medical personnel of an empty supply container. A pair of pressure sensors 50*a* and 50*b* are disposed along the pump tubing segment 16 adjacent the intake/output tubes, 10 and 14 in order to 1) ensure that the tubes are properly mounted in the pump 20; and 2) detect any occlusions in the intake tube 10 or the output tube 14 of the delivery set 8. A retention plate 54 is attached to the housing 24 by a screw 58 to hold the pressure sensors 50*a* and 50*b* in place. As will be appreciated, if the sensors are not securely held, any readings obtained will be unreliable.

As will be apparent from the drawings in FIG. 1, the rollers 34*a*, 34*b* and 34*c* have a relatively small diameter. The small diameter helps the rollers 34 to pinch off the tubing segment 38. However, the small rollers 34 also decrease the possible moment arm, thereby reducing mechanical advantage and increasing the current drawn. The tubing must also be more severely deformed, which also requires more current draw.

Figure 2:
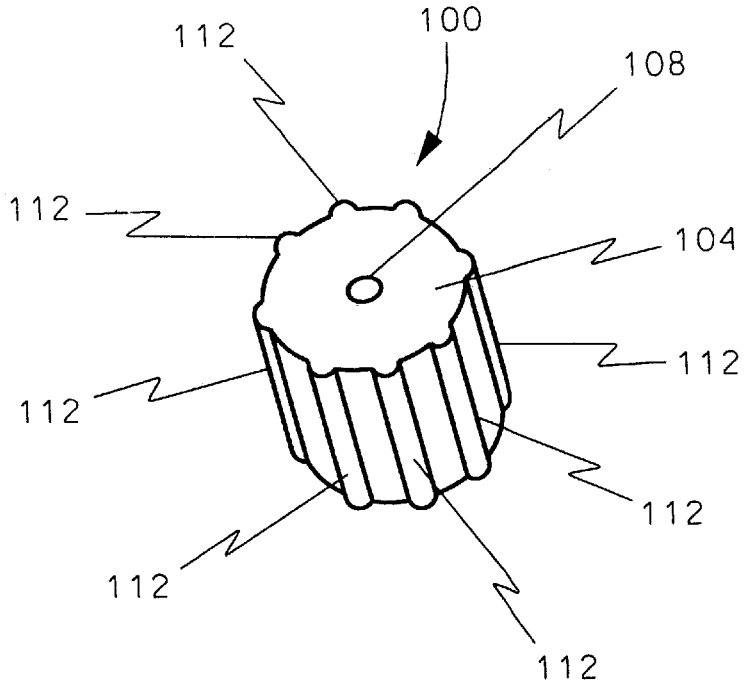
FIG. 2 shows a perspective view of a roller made in accordance with the principles of the present invention.

Turning now to FIG. 2, there is shown a perspective view of a roller, generally indicated at 100, made in accordance with the principles of the present invention. The roller 100 has a central portion 104 with a hole 108 formed therein for receiving a pin (not shown) about which the roller 100 rotates. Those skilled in the art will appreciate that the hole could be replaced with a pair of shafts or nubs extending from the central portion 104 and engaging some support structure to enable rotation of the roller.

The central portion 104 is preferably about 0.325 inches in diameter. This is in contrast to a conventional roller which is about 0.215 inches in diameter. As with conventional rollers, the central portion 104 is preferably made from plastics such as acetal, ABS or nylon.

Extending from the central portion 104 are a plurality of projections 112. The projections 112 are preferably disposed parallel to the long axis of the central portion 104 (i.e. the axis about which the roller 100 rotates during use) and extend the length of the roller. Those skilled in the art will appreciate, however, the projections 112 could be formed into segments which still provide sufficient projection to help pinch off the tube.

The projections 112 preferably extend outwardly approximately 0.20 inches from the central portion 104. While the projections 112 must extend a sufficient distance to help pinch off the tube, they must also not be so long that the outer ends are spaced too far apart that they will not rotate smoothly.

Figure 3:
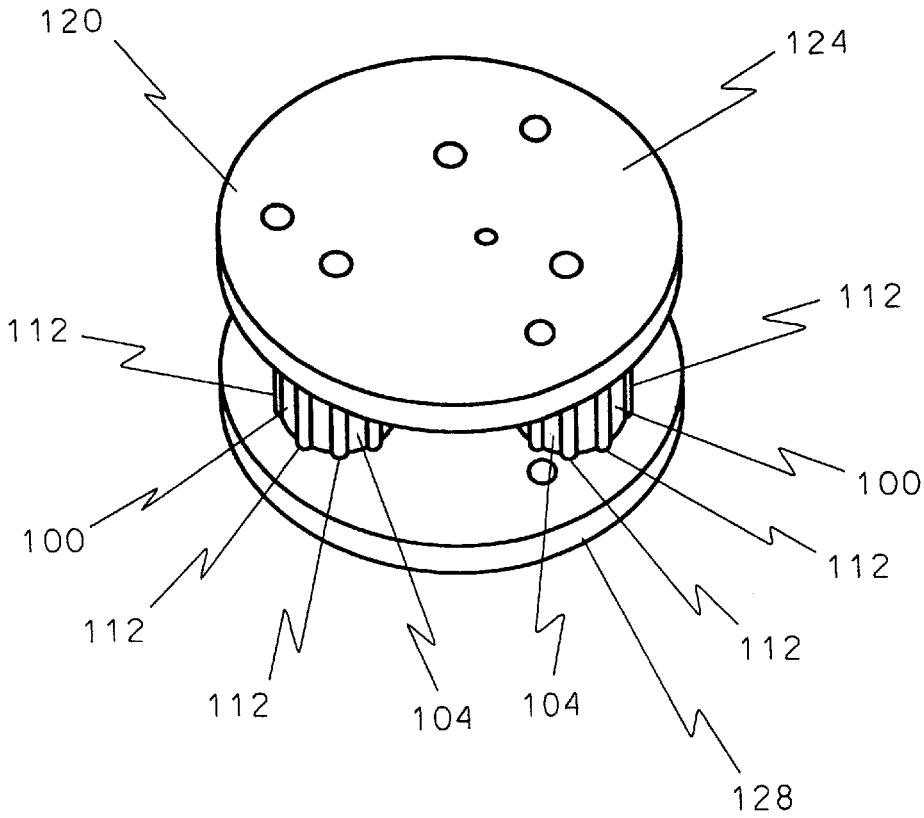
FIG. 3 shows a perspective view of a pump rotor with a plurality of rollers disposed therein, the rollers be formed consistent with the roller discussed in FIG. 2.

Turning now to FIG. 3, there is shown a perspective view of a pump rotor 120. The pump rotor 120 has a top plate 124 and a bottom plate 128. Disposed between the top plate 124 and the bottom plate 128 are three rollers 100 (only two of which are visible). The space between the top plate 124 and the bottom plate 128 is preferably slightly larger than the diameter of the tube which will be engage by the rollers 100 to pump solution through the tube.

As the rotor 120 rotates, the rollers 100 engage the tube and force the solution in the tube downstream. Because the rollers 100 are larger in diameter than the prior art, a larger moment arm is created and a lower current draw is required. However, because of the projections 112, the tube is properly pinched closed and the volumetric accuracy of the system is maintained. The small projections 112 reduce the amount of flexible tubing which must be severely deformed to effect a seal.

Figure 4:
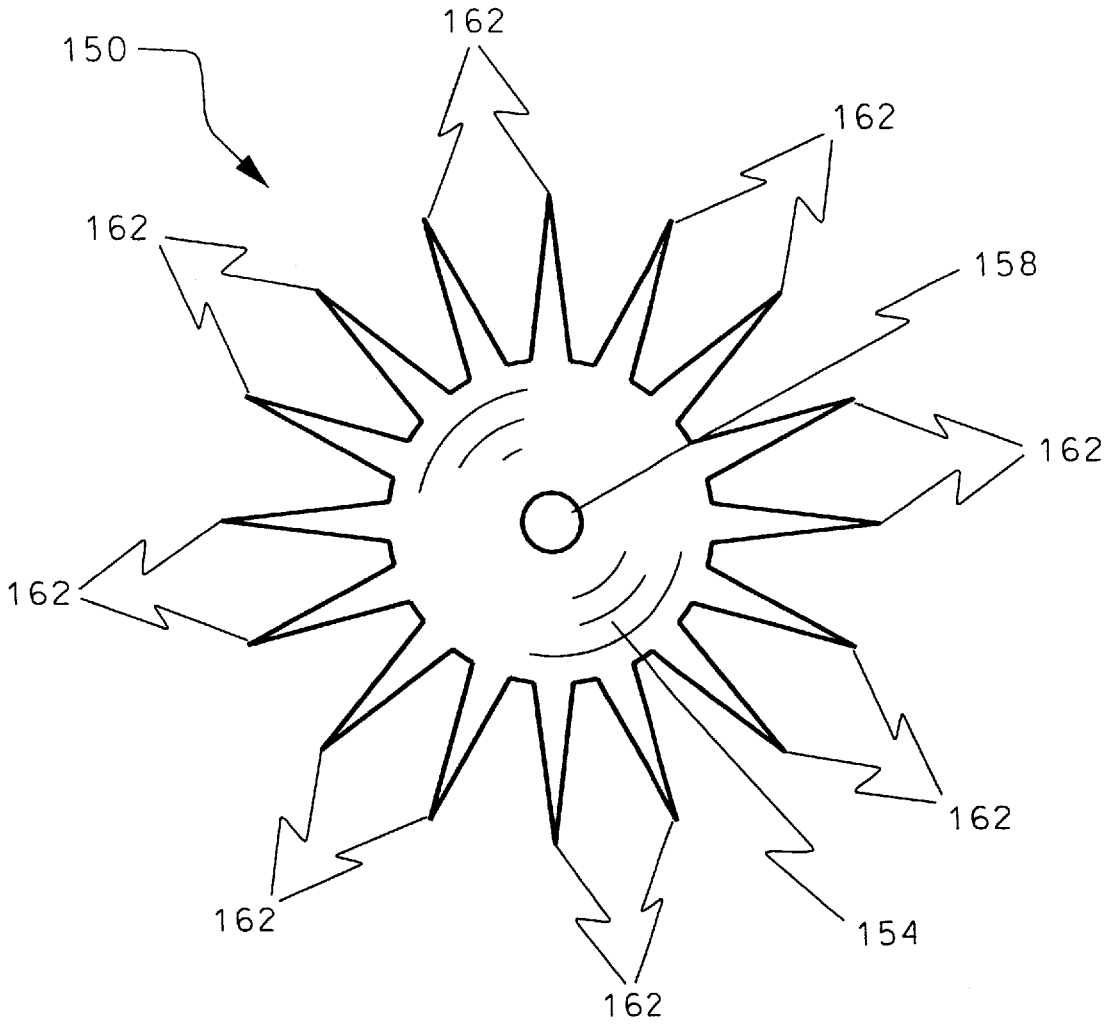
FIG. 4 shows an alternate embodiment of a roller made in accordance with the principles of the present invention.

FIG. 4 shows an alternate embodiment of a roller, generally indicated at 150, made in accordance with the principles of the present invention. The roller 150 has a central portion 154 which includes a short shaft 158 extending outwardly from the central portion. The opposing side of the roller 150 also includes a shaft so that the two shafts can engage plates of a rotor (not shown) and enable rotation of the roller.

Extending outwardly from the central portion 154 are a plurality of projections 162. Unlike the embodiment shown in FIGS. 2 and 3, the projections 162 of the roller 150 make up nearly half of the overall diameter of the roller. If desired, the rollers could provide even a greater portion of the diameter.

It is not necessary that all of the projections be the same length. However, it is important that the projections be spaced sufficiently to enable the feeding tube to be pinched off, but not so great that the roller 150 is unable to roll smoothly along the tube and squeeze out any solution which has been trapped in the segment 38*a* in FIG. 1.

Figure 5:
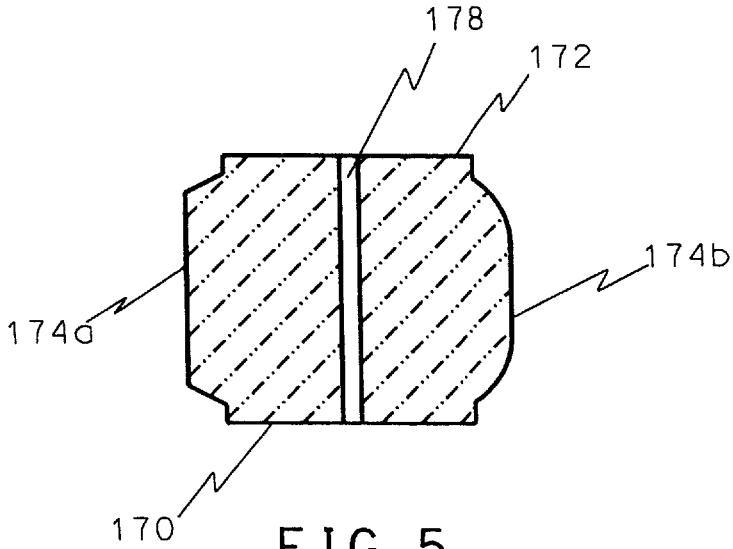
FIG. 5 shows a cross-sectional view of yet another embodiment of the principles of the present invention.

FIG. 5 shows a cross-sectional view of yet another roller 170 formed in accordance with the principles of the present invention. While it is preferred that the projections extend the length of the roller 170, this is not a requirement. Thus, as shown in FIG. 5, the projections 174*a* and 174*b* extending from the central portion 172 are shorter than the length of the central portion of the roller 170. This is feasible because the thickness of the annular wall forming the tube allows the tube to be pinched off without applying force over the entire diameter. Furthermore, as demonstrated by projections 174*a* and 174*b*, the projection can have a linear engagement face extending parallel to the hole 178, or can have a rounded engagement face as shown by projection 174*b*. Alternatively, the projections (shown as 174*a* and 174*b*) could be aligned at an angle relative to the hole 178.

The number of projections which are present on a roller, such as rollers 100, 150 or 170 will depend, in part, on the type of tube which the roller is to engage. Presently, however, it is believed that between 4 and 16 projections are preferred, with 8 being the most preferred number.

While FIGS. 2 through 5 show several presently preferred embodiments, those skilled in the art will appreciate that numerous modifications thereto can be used. The length of the projections can be modified, as can the shape of each projection, to provide the optimal tube engagement and performance characteristics. Those skilled in the art will be able to determine numerous different embodiments of peristaltic rotor rollers in light of the teachings of the present application.

Thus there is disclosed an improved roller for peristaltic pumps. Those skilled in the art will appreciate numerous modifications which can be made without departing from the scope and spirit of the present invention. The appended claims are intended to cover such modifications.

What is claimed is:

1. A method for reducing the amount of current draw by a peristaltic pump, comprising the steps of:

selecting a rotor having a plurality of rollers, each of the rollers having an overall diameter of less then one inch and at least one of the rollers having a plurality of projections extending radially outwardly, the projections being spaced apart sufficiently that the projections help to pinch off a tube when the tube is wrapped about the rotor;

wrapping a tube around the rotor so that the tube is in contact with at least two of said rollers; and rotating the roller.

2. The method according to claim 1, wherein the roller has a central portion between about 0.30 inches and 0.325 inches in diameter.

3. The method according to claim 1, wherein the method comprises placing the tube in tension with the rollers.

4. The method according to claim 1, wherein the tube has an outside diameter of ¼ of an inch.

5. A roller for a peristaltic pump, the roller comprising:

a central portion configured for rotation about an axis, the central portion being between about 0.30 and 0.325 inches; and a plurality of projections extending radially outwardly from the central portion, the projections being spaced from one another sufficiently so as to facilitate pinch off of an infusion tube when the tube is wrapped at least partially round the roller.

6. The roller according to claim 5, wherein the projections extend the length of the central portion.

7. The roller according to claim 5, wherein at least one of the plurality of projections has a linear engagement face.

8. The roller according to claim 5, wherein at least one of the plurality of projections has a rounded engagement face.

9. The roller according to claim 5, wherein the plurality of projections consists of between 4 and 16 projections.

10. The roller according to claim 5 wherein the plurality of projections consists of eight projections.

11. The roller according to claim 5, wherein the central portion has a pair of shafts extending axially therefrom and configured for rotation of the central portion.

12. The roller according to claim 5, wherein the roller has an overall diameter of at least 0.30 inches, but less than 1 inch.

13. A rotor for selectively moving liquid through a tube, the rotor comprising:

at least one plate disposed in communication with a motor unit; and a plurality of rollers attached to the at least one plate, each of said plurality of rollers comprising a central portion and a plurality of projections extending from the central portion, the central portion having an overall diameter of about 0.325 inches inches, and the projections being spaced apart so as to facilitate pinching off of an infusion tube.

14. The rotor according to claim 13, wherein the each roller of the plurality of rollers has a plurality of projections extending radially outwardly from the central portion.

15. The rotor according to claim 14, wherein each of the rollers has at least one projection having a linear engagement face.

16. The rotor according to claim 14, wherein each of the rollers has at least one projection having a rounded engagement face.

17. The rotor according to claim 14, wherein the central portion of each roller has a length, and wherein each roller has least one projection which extends the length of the central portion.

18. A method for pumping solution through a tube, the method comprising:

selecting a rotor having a plurality of rollers, the rotor being powered by a motor powered a battery, each roller having a plurality of projections extending radially outwardly; and wrapping the tube at least partially around the rotor so that the rollers selectively engage and pinch off portions of the tube.

19. The method according to claim 18, wherein the method comprises rotating the rotor to cause the projections of the roller to engage the tube and thereby force solution through the tube.

20. The method according to claim 18, wherein the method comprises wrapping a smooth tube about the rollers.

* * * * *